US005907271A

United States Patent [19]

Hirano et al.

[11] Patent Number: 5,907,271

[45] Date of Patent: May 25, 1999

[54] POSITIVE CHARACTERISTIC THERMISTOR DEVICE

[75] Inventors: Atsushi Hirano, Ohmihachiman; Shigeyuki Kuroda; Kenji Tanaka, both of Shiga-ken, all of Japan

[73] Assignee: Murata Manufacturing Co., Ltd., Kyoto-fu, Japan

[21] Appl. No.: 08/763,365

[22] Filed: Dec. 11, 1996

[30] Foreign Application Priority Data

Dec. 13, 1995 [JP] Japan ..... 7-347321

[51] Int. Cl.[6] ..... H01C 7/10

[52] U.S. Cl. ..... 338/22 R; 338/225 D; 29/612

[58] Field of Search ..... 29/612; 338/22 R, 338/225 D

[56] References Cited

U.S. PATENT DOCUMENTS

| | | | |
|---|---|---|---|
| 2,720,573 | 10/1955 | Lundqvist | 338/22 SD |
| 3,878,501 | 4/1975 | Moorhead et al. | 338/22 R |
| 4,024,427 | 5/1977 | Belhomme | 338/22 R |
| 4,259,657 | 3/1981 | Ishikawa et al. | 338/22 R |
| 5,166,658 | 11/1992 | Fang et al. | 338/23 |
| 5,425,099 | 6/1995 | Takakura et al. | 379/413 |
| 5,488,348 | 1/1996 | Asida et al. | 338/22 R |
| 5,602,520 | 2/1997 | Baiatu et al. | 338/22 R |

FOREIGN PATENT DOCUMENTS

| | | | |
|---|---|---|---|
| 0 751 539A2 | 1/1997 | European Pat. Off. . | |
| 59-116536 | 7/1984 | Japan . | |
| 64-001205 | 1/1989 | Japan . | |
| 1-216503 | 8/1989 | Japan | 338/22 R |
| 4-206901 | 7/1992 | Japan | 338/22 R |
| 6-302403 | 10/1994 | Japan . | |

OTHER PUBLICATIONS

"Porosification Effect on Electroceramic Properties" H. T. Sun et al., Key Engineering Materials, vol. 115, 1996, Transtech Publications, Switzerland, ISSN 1013–9826, pp. 167–180, XP 000646633.

"Preparation of Porous $BaTiO_3$ PTC Thermistors by Adding Graphite Porosifiers",Shi–Mei Su et al, Journal of the American Ceramic Society, Aug. 1994, vol. 77, No. 8, ISSN 0002–7820, pp. 2154–2156, XP 000647760.

*Primary Examiner*—Michael L. Gellner
*Assistant Examiner*—Karl Easthom
*Attorney, Agent, or Firm*—Burns, Doane, Swecker & Mathis, L.L.P.

[57] ABSTRACT

A positive characteristic thermistor device includes a device main body made of a semiconductor ceramic material which reliably and cleanly delaminates upon the application of excessive voltage thereto. The main body has outer layers having lower porosity formed on both sides of an inner layer having higher porosity. The inner layer having higher porosity can be obtained by burning a ceramic material for positive characteristic thermistors including resin beads mixed therein. After forming the main body, an electrode is formed on the outer surface of each of the outer layers. When an overvoltage is applied to this positive characteristic thermistor device, delamination occurs in the inner layer having higher porosity to create an open-circuit in a circuit in which the thermistor device is connected.

11 Claims, 5 Drawing Sheets

Fig. 7(a)
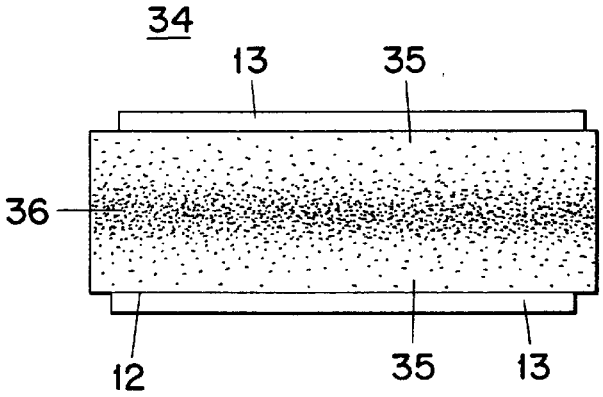
Fig. 7(b)
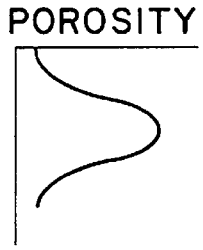
Fig. 8(a)
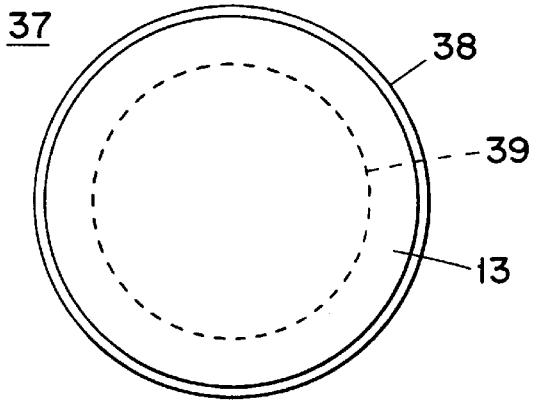
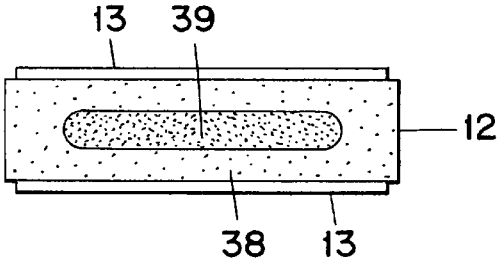
Fig. 8(b)

POSITIVE CHARACTERISTIC THERMISTOR DEVICE

BACKGROUND OF THE INVENTION

1. Field of the Invention

The present invention relates to positive characteristic thermistor devices made of semiconductor ceramic materials.

2. Description of the Related Art

Conventional positive characteristic thermistor devices (i.e., positive temperature characteristic devices having a positive temperature coefficient, or "PTC devices") include a structure as shown in FIG. 1. This positive characteristic thermistor device 1 is formed by providing electrodes 3 on opposite sides of a device main body 2 made of a substantially uniform semiconductor ceramic material, and electrically connecting a lead wire 4 to each of the electrodes 3 by means of soldering or like technique. Such a PTC device is used for various applications including protection of a circuit against excess current flowing in the circuit (referred to hereafter as an "overcurrent") because of the fact that its resistance abruptly increases at a temperature equal to or higher than the Curie point. Specifically, when an overcurrent flows through the PTC device, the temperature of the PTC device abruptly increases which in turn greatly increases the resistance of the device. This cuts off the current to the circuit in which the PTC device is inserted, thereby protecting the circuit against the overcurrent.

A conventional PTC device also exhibits a self-resetting property as a protection measure, wherein the PTC device shorts due to erroneous wiring resulting in application of an excessive voltage (hereinafter referred to as "overvoltage") on the order of 200 V. The PTC device returns to its initial state when the overvoltage is removed, which eliminates the need for replacing the PTC device.

When a voltage is abruptly applied through the lead wire 4 to the PTC device 1 as shown in FIG. 1, the device main body 2 generates heat. FIG. 2 shows the result of a measurement made using an infrared temperature analyzer of the temperature distribution in the PTC device during the generation of heat at the time of energization. In FIG. 2, the temperature distribution in the PTC device 1 is illustrated using isothermal lines 5. As shown in FIG. 2, the temperature is higher in an inner region of the PTC device 1 and lower at the surface of the device. As a result, when a voltage is abruptly applied to the PTC device 1, breakage can occur due to thermal stress originating from the temperature difference between the inner region and the surface of the device.

A close study of this breakage phenomenon due to thermal stress led the present inventors to the following insight into the breakage mechanism of the device. When a voltage is abruptly applied to the PTC device, heat is generated in the PTC device by the current that flows therethrough. The temperature becomes higher in an inner region of the device than in a surface region thereof due to a difference in heat dissipation properties between the inner and surface regions of the device. If the temperature is higher in the inner region of the device, the inner region of the device will have a resistance higher than that of the surface region. This further increases the amount of heat generated in the device inner region. The temperature difference between the inner and surface regions of the device increases because of their different heat dissipating properties and the increase in the resistance of the device. A resultant difference in the thermal expansion properties between the inner and surface regions of the device leads to breakage of the PTC device.

Because of the potential for breakage due to thermal stress as described above, a circuit is sometimes protected due to the breakage of the PTC device when an overvoltage as high as 600 V is applied to the PCT device. That is, the breakage creates an open-circuit which prevents damage to the circuit. However, when a conventional PTC device is broken by an overvoltage on the order of 600 V, the breakage of the device main body often is such that the device main body is cracked rather than being completely broken. If a PTC device is cracked instead of being completely broken (such a mode of breakage is hereinafter referred to as "insufficient breakage"), sparks occur at the cracked regions, resulting in a short circuit in the PTC device. This causes a very high overcurrent to flow through the circuit when the device is used, for example, as a component for protecting a circuit from an overcurrent. This can lead to critical accidents, e.g., a short circuit of the terminal equipment and damage resulting therefrom.

A current fuse can be used instead of a PTC device, but current fuses have their own disadvantages. More specifically, a current fuse blows out upon the application of excess current and voltages and does not have a self-resetting property. That is, a current fuse operates by blowing out even upon the application of an overvoltage on the order of 200 V and, in each of such blow outs, the current fuse must be replaced. This has been inconvenient due to the troublesome maintenance operations that must be carried out.

It is an exemplary object of the present invention to solve the above-described problems, and more specifically to provide a positive characteristic thermistor device capable of reliably and quickly cutting off a current to produce an open circuit when overvoltage is applied thereto.

A positive characteristic thermistor device according to a first aspect of the invention includes a device main body having a multi-layer structure including three or more semiconductor ceramic layers. The device main body includes a ceramic layer having relatively high porosity sandwiched between ceramic layers having relatively low porosity.

In this positive characteristic thermistor device, the ceramic layer having relatively high porosity is sandwiched between the ceramic layer having relatively low porosity. Therefore, when a high overvoltage is applied to the device or a high overcurrent flows through the device, the heat generated in the ceramic layer of higher porosity (having higher resistance) is higher than the heat generated in the ceramic layers of lower porosity (having lower resistance). This results in a difference in the degree of thermal expansion between the ceramic layer of higher porosity and the ceramic layers of lower porosity. As a result, thermal stress develops in these regions, which causes delamination (that is, breakage) of the positive characteristic thermistor device near the ceramic layer of higher porosity.

Further, since the ceramic layer of higher porosity is lower in strength, it is more prone to delamination when an overvoltage is applied thereto or an overcurrent flows therethrough. This allows the positive characteristic thermistor to reliably enter a non-conductive state to eliminate the possibility of insufficient breakage when an overvoltage is applied to or an overcurrent flows through the positive characteristic thermistor device.

A positive characteristic thermistor device according to a second aspect of the invention includes a device main body made of a semiconductor ceramic material which has a region having porosity higher than that of neighboring regions.

In the positive characteristic thermistor device according to the second aspect of the invention including a region having porosity higher than that of its neighboring regions, when a high overvoltage is applied to or a high overcurrent flows through the positive characteristic thermistor device, a disproportionate amount of heat is generated in the region of higher porosity. Consequently, thermal stress develops between the high porosity region and the neighboring regions. This causes delamination in the positive characteristic thermistor device. Further, the region having higher porosity (which is surrounded by the neighboring regions of lower porosity) radiates heat poorly, which promotes the development of thermal stress and consequently delamination of the positive characteristic thermistor device. Moreover, the region having higher porosity is lower in strength, which further promotes delamination. Thus, the positive characteristic thermistor device according to the second aspect of the invention can also reliably enter a non-conductive state when an overvoltage is applied thereto or an overcurrent flows therethrough to eliminate the possibility of insufficient breakage.

A positive characteristic thermistor device according to a third aspect of the invention includes a device main body made of a semiconductor ceramic material having porosity continuously varying from a surface region thereof toward an inner region thereof. Further, the device main body includes a region having relatively high porosity in which the varying porosity exhibits a maximum value.

The positive characteristic thermistor device according to the third aspect of the invention including a region having a maximum porosity also provides delamination in the region of the maximum porosity due to thermal stress caused by generation of heat in the ceramic layer having the maximum porosity when a high overvoltage is applied thereto or a high overcurrent flows therethrough. Moreover, the region having higher porosity is lower in strength, which further promotes delamination. Thus, the positive characteristic thermistor device according to the third aspect of the invention can also reliably enter a non-conductive state when an overvoltage is applied thereto or an overcurrent flows therethrough to eliminate the possibility of insufficient breakage. The porosity can vary in any of one-dimensional (laminar), two-dimensional and three-dimensional modes.

According to a fourth aspect of the invention, there is provided a positive characteristic thermistor device in accordance with any of the first, second and third aspects, characterized in that the porosity is at a maximum in a portion substantially in the center of the device main body. Providing a maximum porosity in the center of the main body can be achieved by providing a central portion of the device main body having a ceramic layer with relatively high porosity, by providing a region having porosity higher than that of its neighboring regions, or providing a region in which the porosity exhibits a maximum value. Since heat generated in these high porosity regions is difficult to release, thermal stress between these regions and the neighboring regions (e.g. regions on both sides of the high porosity region) is further promoted. This phenomenon more reliably induces delamination of the positive characteristic thermistor upon the application of an overvoltage or overcurrent thereto.

BRIEF DESCRIPTION OF THE DRAWINGS

FIG. 7*a* is a side view of a PTC device according to another exemplary embodiment of the present invention.

FIG. 7*b* is a diagram illustrating a change in porosity in the device main body shown in FIG. 7*a*.

FIG. 8*a* is a plan view of a PTC device according to another exemplary embodiment of the present invention, and FIG. 8*b* is a sectional view of the same.

DETAILED DESCRIPTION OF PREFERRED EMBODIMENTS

Figure 1:
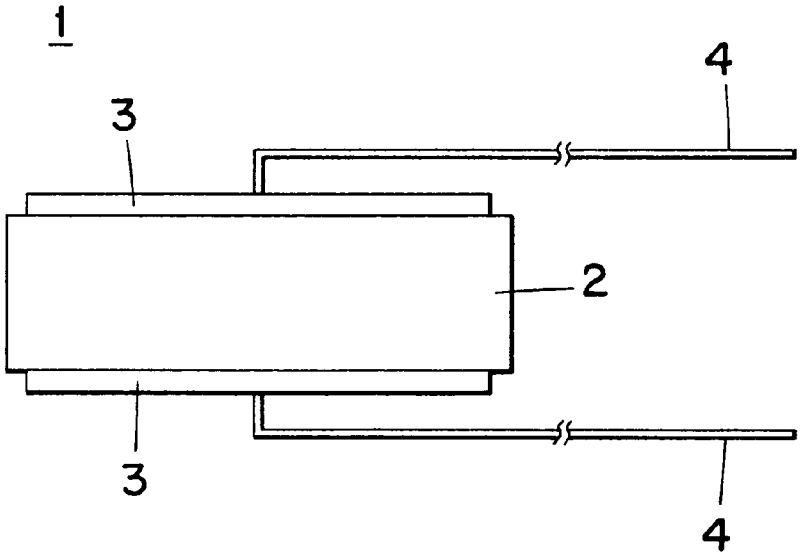
Fig. 1 (PRIOR ART)
FIG. 1 is a side view of a conventional PTC device.
Figure 2:
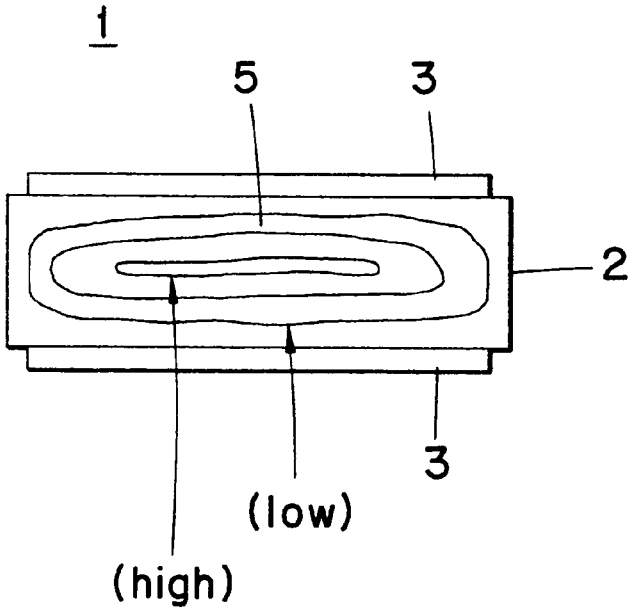
Fig. 2 (PRIOR ART)
FIG. 2 is an isothermal line diagram showing temperature distribution in the device main body shown in FIG. 1.
Figure 3:
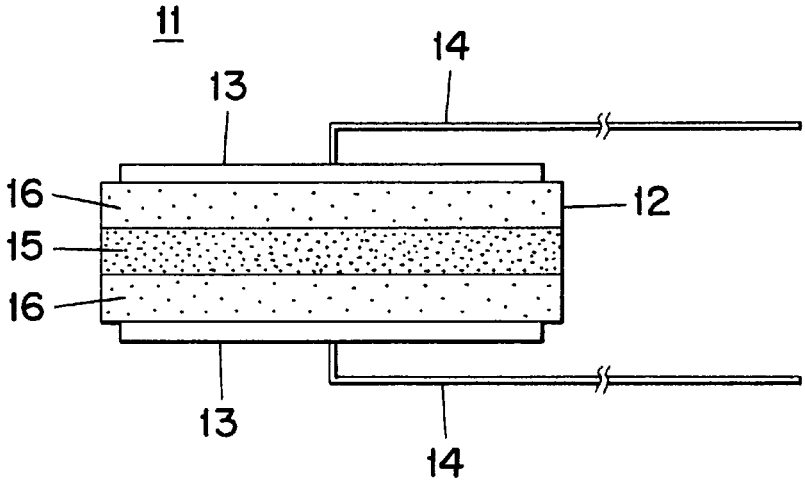
FIG. 3 is a side view of a PTC device according to an exemplary embodiment of the present invention.

FIG. 3 is a sectional view of a PTC device 11 according to an embodiment of the present invention. In the PTC device 11, electrodes 13 are formed on opposite sides of a device main body 12 made of a semiconductor ceramic material having positive temperature characteristic, and a lead wire 14 is conductively connected to each of the electrodes 13 by means of, for example, soldering. The device main body 12 made of a semiconductor ceramic material having positive temperature characteristic has a three-layer structure of an inner layer 15 in the middle thereof and outer layers 16 formed on both sides of the inner layer 15. The porosity in the semiconductor ceramic material is higher in the inner layer 15 of the device main body 12 than in the outer layers 16 (e.g. the inner layer 15 has a higher ratio of pores than the outer layers 16).

The PTC device 11 having the above-described configuration can be manufactured, for example, in the following manner. First, there is prepared a material for the outer layers which, for example, can comprise a ceramic material for positive characteristic thermistors without resin beads, and a material for the inner layer which, for example, comprises the same ceramic material for positive characteristic thermistors mixed with resin beads in an appropriate amount. Although there is no strict requirement for the size and shape of the resin beads, the beads of an exemplary embodiment are larger than the pores in the ceramic material for positive characteristic thermistors and are in a spherical shape. Further, the main component of the resin beads can be any substance that disappears (e.g. dissolves) during burning, such as PMMA (methacrylic resin) and polystyrene.

A predetermined amount of the outer layer material is filled in a dry press type metal mold (not shown) and is pressed at a low pressure. Then, a predetermined amount of the inner layer material is filled on top of the outer layer material which has been press-molded, and the resultant combination is pressed at a low pressure. A predetermined amount of the outer layer material is further filled on top of the press-molded inner layer material, and the entire product thus obtained is pressed at a higher pressure to obtain a molded element consisting of three layers. The molded element having a three-layer structure consisting of the inner layer 15 and the outer layers 16 is burned at a predetermined temperature. The resin beads disappear during this burning process to form pores in the device main body. Then, conductive paste is applied to both opposite surfaces of the molded element to provide the electrodes 13 on both sides of the molded element (device main body 12). Further, a lead wire 14 is conductively connected to each of the electrodes 13 by means of soldering.

Figure 4:
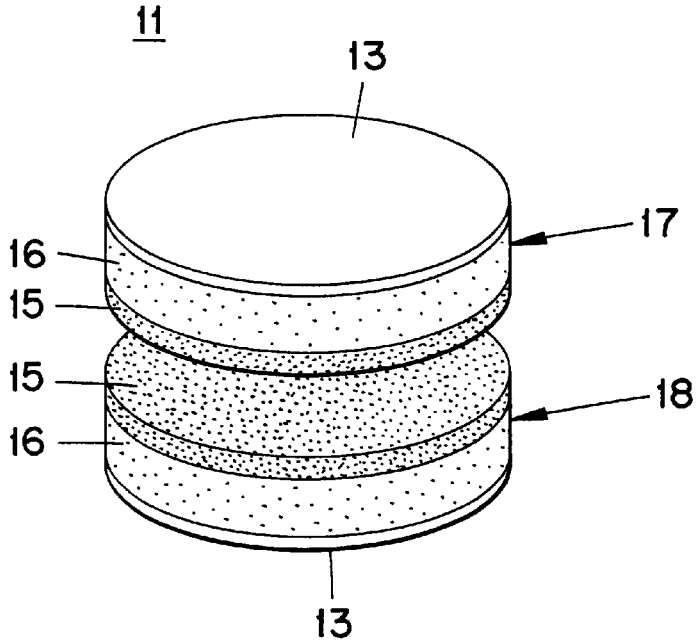
FIG. 4 is a perspective view of the PTC device in FIG. 3 which has been subjected to delamination.

When a voltage on the order of 200 V is applied to the PTC device 11 having such a structure as described above, the device performs a resettable protecting operation like a convention PTC device without being broken. When an increased voltage (i.e., overvoltage) on the order of 600 V is applied to the PTC device 11, however, the PTC device 11 is not subjected to insufficient breakage, unlike the conventional device. Instead, it is split into two parts in a laminar mode at the inner layer 15 as shown in FIG. 4, which divides the device main body 12 into broken pieces 17 and 18. As apparent from FIG. 4, the laminar breakage of the PTC device 11 allows the circuit in which the PTC device 11 is inserted to be reliably open-circuited in the event of an overvoltage.

Twenty PTC devices of the above-described embodiment were produced using the above-described method of manufacture. According to one exemplary embodiment, a barium titanate type semiconductor material was used for the ceramic material for the positive characteristic thermistors for forming the inner and outer layers. About 0.62 g of outer layer material was filled in the dry press metal mold and was pressed at a pressure of about 40 MPa. About 0.62 g of inner layer material including spherical PMMA resin beads having a diameter of about 10–30 $\mu$m was added thereon and was pressed at about 40 MPa. Further, about 0.62 g of the outer layer material was added to the product and, thereafter, the entire product was pressed at about 120 MPa. The above-described process thereby formed a three-layer molded element having a diameter of about 17.8 mm and a thickness of about 2 mm which was then burned. After the burning, which was followed by application of the electrodes, the diameter of the three-layer molded element was reduced to about 14.0 mm. In the PTC devices produced in such a manner, the porosity (area ratio) of the outer layers without resin beads was about 11% while the porosity (area ratio) of the inner layer including resin beads was about 12–18%. Twenty conventional PTC devices were produced as examples for comparison in which a device main body was formed of a ceramic material for positive characteristic thermistors having only one layer and including no resin beads. Tests were carried out on each of the twenty PTC devices constructed according to the present invention and on the conventional devices. More specifically, tests were performed to measure the resistance of the device and to determine the flash withstand voltage of the device. The test of flash withstand voltage is to check whether a PTC device is broken or not upon instantaneous application of an overvoltage in the form of a pulse. More specifically, a flash withstand voltage corresponds to the voltage that the PTC device is able to withstand just prior to the point where it breaks. The results of such tests are shown on Table 1. The values of resistance shown in Table 1 represent average values of the twenty PTC devices, and the values of flash withstand voltage represent minimum values of the twenty PTC devices. Table 1 also shows the number of PTC devices which were subjected to laminar breakage and the number of PTC devices which were subjected to insufficient breakage during the flash withstand voltage test.

TABLE 1

| | Embodiment With 3 Layers | Example For Comparison |
|---|---|---|
| Resistance (Average Value) | 6Ω | 6Ω |
| Flash Withstand Voltage (Minimum Value) | 280V | 280V |
| Number of Devices Measured | 20 | 20 |
| Number of Devices Subjected to Laminar Breakage | 20 | 12 |
| Number of Device Subjected to Insufficient breakage | 0 | 8 |

As seen in Table 1, according to this specific embodiment, there is no difference in the resistance and flash withstand voltage between the above-described embodiment and the conventional devices. However, referring to the mode of breakage in the flash withstand voltage test, about half of the conventional PTC devices were subjected to insufficient breakage while all of the PTC devices of the embodiment described above were subjected to laminar breakage.

The following theory explains why the PTC devices of the above-described embodiment do not differ from the conventional PTC devices with regard to the flash withstand voltage level, but do differ in the breakage mode in their greater propensity to break cleanly in half. The conductive path in the inner layer of a PTC device according to exemplary embodiments of the invention is reduced by the presence of pores, which results in an increase in the specific resistance of the inner layer because of the microscopic structure employed. Thus, when an overvoltage is abruptly applied, concentration of electric fields occurs in the inner layer having the increased specific resistance, resulting in an increase in the mount of heat generated in this region. However, a significant reduction in the flash withstand voltage can be avoided because the pores introduced therein absorb and reduce the thermal stress.

When a higher overvoltage is applied, however, the ability of the pores introduced therein to absorb and reduce thermal stress is exceeded, resulting in laminar breakage of the PTC device. Specifically, since the introduction of pores has reduced the total sectional area of the conductive path, concentration of electric fields occurs in the inner layer which increases the amount of heat generated therein. This results in a temperature difference between the inner and outer layers much greater than that in a conventional PTC device, and poor heat dissipating properties of the inner layer compared to that of the outer layers further increases the temperature difference between the inner and outer layers. Further, a dimensional difference between the inner and outer layers is increased by thermal expansion and, in addition, the strength of the inner layer has been reduced due to the presence of pores. These factors combine to cause a crack running throughout the inner layer which leads to laminar breakage. Further, according to the exemplary embodiments of present invention, the presence of pores allows the specific resistance of the inner layer to be increased without making the device main body thicker, and it is therefore possible to produce a compact PTC device in which delamination can be reliably induced.

Alternate Embodiments

Figure 5:
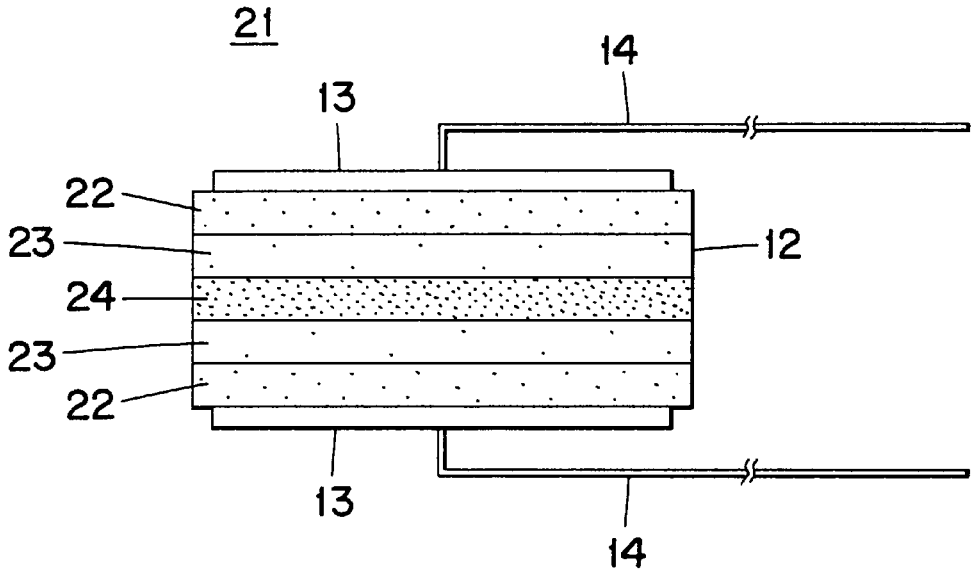
FIG. 5 is a side view of a PTC device according to another exemplary embodiment of the present invention.

Although a PTC device 11 having a three-layer structure of an inner layer 15 and outer layers 16 on both sides thereof has been shown in the above embodiment, it is possible to employ a multi-layer structure having more than three layers in which the deeper a layer is in the structure, the higher the porosity of the material is for that layer. For example, FIG. 5 shows a case wherein a device main body has a five-layer structure. In a PTC device 21 shown in FIG. 5, an outermost layer 22 of a device main body 12 is a semiconductor ceramic layer having medium porosity; a central layer 24 is a layer having the highest porosity; and an intermediate layer 23 between the outermost layer 22 and the central layer 24 is a layer having the lowest porosity. In the PTC device 21 having such a structure, delamination again reliably occurs at the central layer 24 having low strength due to thermal stress between the central layer 24 of the highest porosity and the intermediate layer 23 of the lowest porosity when an overvoltage is applied.

Figure 6:
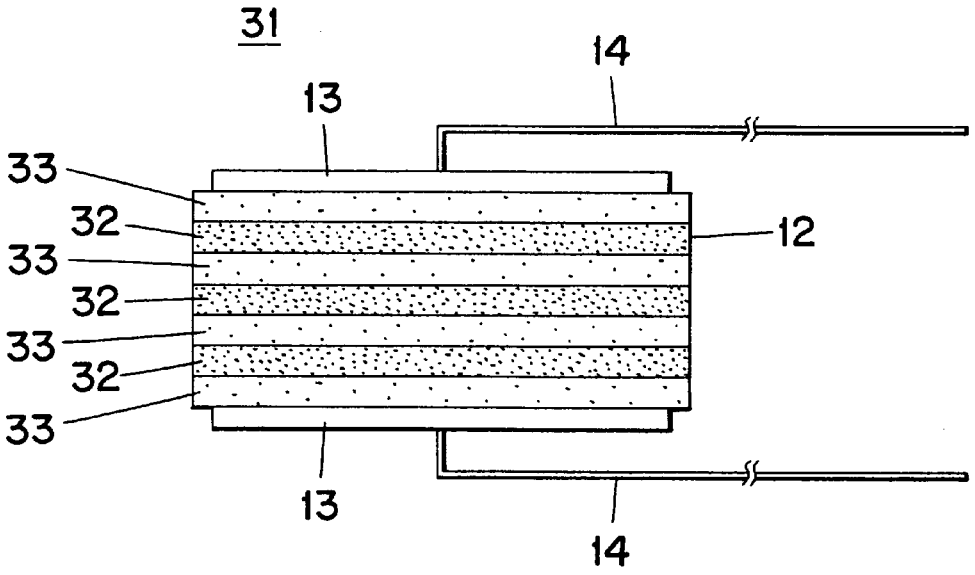
FIG. 6 is a side view of a PTC device according to another exemplary embodiment of the present invention.

FIG. 6 is a side view of another embodiment of the present invention. A device main body 12 of a PTC 31 is formed by alternately laminating layers 32 having higher porosity and layers 33 having lower porosity into a lamination having seven layers. The outermost layer is a layer 33 having the lower porosity, and the central layer is a layer 32 having higher porosity. When an overcurrent is applied, delamination is again reliably induced in the PTC device 31 because layer 32 in the center thereof has the higher porosity.

Further, although not shown, a PTC device having a multi-layer structure does not need to have layers in an odd number but can have layers in an even number, such as a number equal to or higher than four.

PTC devices according to the present invention are not limited to those having a multi-layer structure as described above, and devices having variable porosity are possible in which the porosity of the material continuously varies such that the deeper a region is in the device, the higher the porosity is. FIG. 7*a* is a side view of a PTC device 34 having variable porosity, and FIG. 7*b* is a diagram showing the level of porosity in the direction of the thickness of a device main body 12 of the PTC device 34. As illustrated, a central region of the device main body 12 has the highest porosity, and the porosity gradually decreases the closer a surface region 35 becomes. Therefore, delamination also occurs in the device main body 12 of this PTC device 34 at a central region 36 having the highest porosity when an overvoltage is applied.

FIGS. 8*a* and 8*b* are a plan view and a sectional view, respectively, of a PTC device 37 according to still another embodiment of the present invention. In a device main body 12 of this PTC device 37, a region 39 made of a material for positive characteristic thermistors having higher porosity is provided inside a region 38 made of a material for positive characteristic thermistors having lower porosity. That is, the region 39 having higher porosity is surrounded by the region 38 having lower porosity.

When an overvoltage is applied to such a PTC device 37, concentration of electric fields occurs in a central part of the device main body 12, which in conjunction with a difference in heat dissipating properties, results in an increase in the temperature of the central part of the device main body 12. Since the region 39 having higher porosity in the central part of the device main body is low in strength, a crack starts at the central part of the device which causes laminar breakage.

Figure 9A:
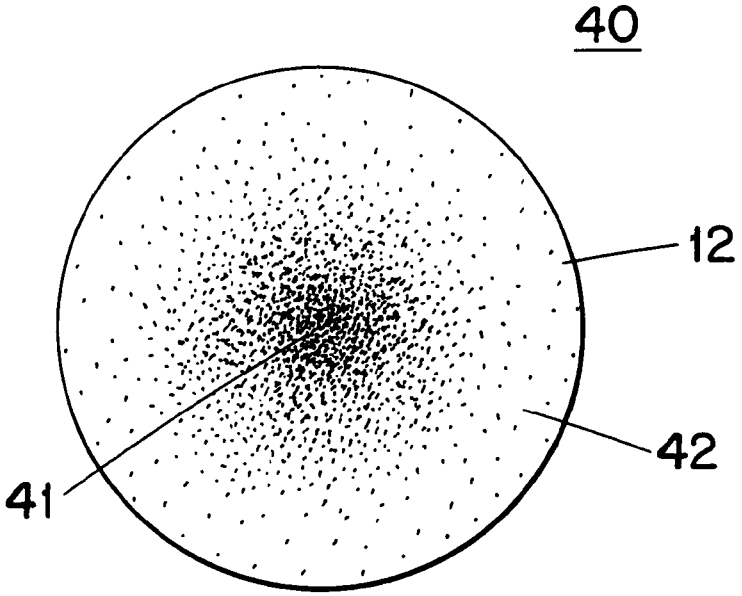
FIG. 9*a* is a sectional plan view of a PTC device according to still another exemplary embodiment of the present invention.
Figure 9B:
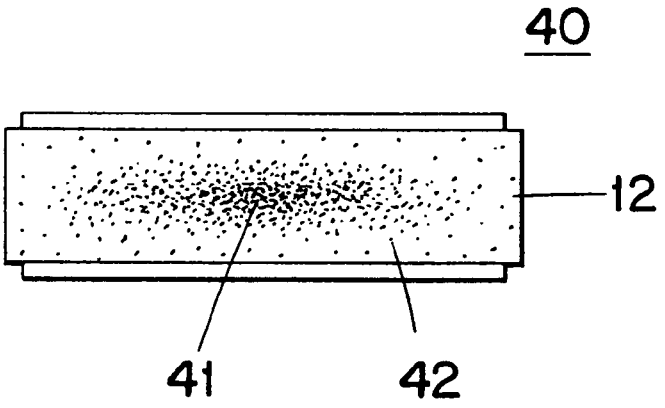
FIG. 9*b* is a longitudinal sectional view of the same.

FIGS. 9*a* and 9*b* are a sectional plan view and a longitudinal sectional view, respectively, of a PTC device 40 according to still another embodiment of the present invention. In this PTC device 40, the distribution of porosity in a device main body 12 varies in a manner similar to the embodiment shown in FIGS. 8*a* and 8*b*. However, the porosity varies continuously rather than abruptly, such that the porosity is at the maximum in a central region 41 and decreases gradually toward the minimum at a surface region 42.

When an overvoltage is applied to such a PTC device 40, a crack starts at the central region having high porosity, which causes laminar breakage as in the PTC device 37 shown in FIGS. 8*a* and 8*b*.

Although disc-shaped PTC devices have been described in the above embodiments, the PTC device can be in any shape such as ring-like and square-plate-like shapes. The porosity of the material of a device main body can be gradually increased from that in an outer layer or surface region to that in an inner layer or inner region according to any method such as increasing the number of pores (e.g. pore density), the diameter of pores and the like in the inner layer, decreasing the number of pores, the diameter of pores and the like in the outer layer, and/or using different materials for the inner and outer layers so that those layers have different numbers of pores and/or different pore diameters.

Further, although a device main body is produced using dry pressing in the above-described embodiments, any method can be used including a method wherein green sheets produced using an extrusion molding process, doctor blade process, or the like are bonded together on a thermo-compression basis.

Moreover, the porosity of a device main body can vary continuously or discontinuously in a one-dimensional, two-dimensional, or three-dimensional mode. Furthermore, the porosity of a device main body can change in any direction such as a direction parallel or diagonal to the electrodes, or the porosity can change in a manner which describes a linear, "wavy" or other complex porosity distribution.

While particular embodiments of the present invention have been shown and described, it will be obvious to those skilled in the art that changes and modifications can be made without departing from the invention in its broader aspects and, therefore, the appended claims are to encompass within their scope all such changes and modifications as fall within the true spirit and scope of this invention.

What is claimed is:

1. A positive characteristic thermistor device comprising:

a device main body having a multi-layer structure of at least three semiconductor ceramic layers, said device main body including a first ceramic layer having a first porosity sandwiched between second and third ceramic layers having a second and third porosity, respectively, wherein said first porosity is higher than said second and third porosities.

2. The positive characteristic thermistor device according to claim 1, wherein the porosity is at a maximum in a portion in a center of said device main body.

3. The positive characteristic thermistor device according to claim 1, wherein said second porosity equals said third porosity.

4. The positive characteristic thermistor device according to claim 1, further including a fourth and a fifth ceramic layers having a fourth and a fifth porosity, respectively, wherein said fourth ceramic layer is disposed on said second ceramic layer and said fifth ceramic layer is disposed on said third ceramic layer.

5. The positive characteristic thermistor device of claim 4, wherein said fourth porosity is greater than said second porosity but less than said first porosity, and further wherein said fifth porosity is greater than said third porosity but less than said first porosity.

6. The positive characteristic thermistor device of claim 5, wherein said fourth porosity is greater than said second porosity, and said fifth porosity is greater than said third porosity.

7. The positive characteristic thermistor device of claim 6 including at least a sixth and a seventh ceramic layers having a sixth and seventh porosity, respectively, wherein said sixth layer is disposed on said fourth layer and said seventh layer is disposed on said fifth layer, wherein said sixth porosity is less than said fourth porosity, and said seventh porosity is less than said fifth porosity.

8. A positive characteristic thermistor device comprising:

a device main body made of a semiconductor ceramic material having porosity which continuously varies in a thickness direction of said thermistor device, said thickness direction defined by a direction which extends perpendicularly from a surface thereof toward an inner region thereof, said device main body including a center region having a porosity level at which the varying porosity exhibits a maximum value, wherein said porosity continuously increases to said maximum value at said center region of said device main body.

9. The positive characteristic thermistor device of claim 8, where said porosity additionally continuously varies in a direction which is normal to said thickness direction.

10. A method for manufacturing a positive characteristic thermistor device, comprising the steps of:

forming a first layer having a first porosity;

forming, on top of said first layer, a second layer having a second porosity; and forming, on top of said second layer, a third layer having a third porosity;

wherein said second porosity is greater than each of said first and third porosities so as to promote delamination upon application of at least one of increased voltage and current to said thermistor device.

11. The method of claim 10, wherein said step of forming said second layer further comprises a step of adding beads to increase the porosity of a thermistor compound.

* * * * *